US005189848A

United States Patent [19]

Flaherty

[11] Patent Number: 5,189,848

[45] Date of Patent: Mar. 2, 1993

[54] BLADE SHARPENING APPARATUS, BLADE GUIDE AND SHARPENING METHOD

[76] Inventor: Frank Flaherty, 12 Falmouth Landing Rd., East Falmouth, Mass. 02536

[21] Appl. No.: 721,982

[22] Filed: Jun. 27, 1991

[51] Int. Cl.[5] ..... B24B 1/00; B24B 7/00

[52] U.S. Cl. ..... 51/285; 51/102

[58] Field of Search ..... 51/285, 267, 240 R, 51/238 R, 81 BS, 82 BS, 84 BS, 85 BS, 86 BS, 91 BS, 92 BS, 98 BS, 108 BS, 109 BS, 102

[56] References Cited

U.S. PATENT DOCUMENTS

| | | | |
|---|---|---|---|
| 2,645,063 | 4/1953 | Smith | 51/285 |
| 2,694,275 | 11/1954 | Lindsay et al. | 51/102 |
| 4,142,331 | 3/1979 | MacJannette | 51/102 |
| 4,672,775 | 6/1987 | Kummer | 51/102 |
| 4,773,186 | 9/1988 | Kojima | 51/102 |
| 4,984,391 | 1/1991 | Sattler | 51/285 |

FOREIGN PATENT DOCUMENTS

| | | | |
|---|---|---|---|
| 2091144 | 7/1982 | United Kingdom | 51/285 |

*Primary Examiner*—Frank T. Yost
*Assistant Examiner*—Paul M. Heyrana, Sr.
*Attorney, Agent, or Firm*—Thomas A. Kahrl

[57] ABSTRACT

The present invention provides an adjustable blade sharpening apparatus for sharpening cutting blades by controlling the positioning of the blade relative to the grinding wheel to produce multiple facets on the cutting blade with a substantially burr-free cutting edge and method of controlling the angle of and position of a blade employing the blade sharpening apparatus. The blade sharpening apparatus comprises a fixed base supporting a table surface including a vertically mounted rotary grinding wheel mounted on an axle and having a circumferential peripheral cutting edge. A blade guide is provided mounted by a pair of arms on the axle for accurate movement between a lower grinding position and an upper grinding position being supported by an adjustable vertical support member for adjustment of the radial positioning of the blade guide, the support member firmly holding the blade guide in a preselected position for positioning a knife blade in angular relationship with the cutting edge of the grinding wheel holding the cutting edge of the blade in spaced relationship with the arms of the blade guide to permit sharpening of the blade without producing a burr on the cutting edge.

14 Claims, 3 Drawing Sheets

BLADE SHARPENING APPARATUS, BLADE GUIDE AND SHARPENING METHOD

BACKGROUND OF THE INVENTION

Blade sharpening devices commonly used to sharpen knives, particularly kitchen cutlery, typically employ one or more rotably mounted grinding wheels commonly having a cylindrical grinding surface and driven by a motor, typically an electric motor. The grinding wheels employed by such devices typically comprise a blade support and a grinding wheel. Sharpening is accomplished by positioning the blade adjacent a grinding wheel for grinding, the blade being supported on the blade support with the cutting edge in contact with the wheel. Typically current methods fail to produce a sharp edge on kitchen cutlery for the reason that the edge of the blade is permitted to contact the surface of the blade support as well as the grinding stone thereby creating a burr on the cutting edge and leaving the knife blade dull.

In a related field of sharpening where a very sharp edge is sought, that which is burr-free, i.e., razor blades, the standard method of sharpening is to use a plurality, typically two, of opposed grinding wheels, each movably mounted with a gearing mechanism on a parallel axis used to increase the angle of grinding, to produce successive facet angles on the blade, the outermost facet angle being the edge or the tip of the blade. The facet angle which is the included angle contained within the tangents to the two wheel diameters at the point where the tip is formed. Successively grinding operations are performed on the edge or are done at a slightly higher (larger) angle by decreasing the distance between the axis of each wheel and with using finer grit wheels. A control mechanism is used to provide that successive sharpening operations grind less and less material which, with the finer grit produces a smaller radius tip and leaves the tip substantially burr-free.

While this method does produce a very sharp edge, it is expensive, time consuming and requires gearing apparatus to drive the opposing grinding wheels such that the wheels both approach the edge being ground simultaneously. Also the method requires a mechanism to increase the facet angle produced typically by moving the axis of the grinding wheels outwardly. It is therefore desirable to provide a new and improved, economical and simplified cutlery sharpening apparatus and method wherein the sharpening apparatus includes a unitary grinding wheel [mounted in fixed relationship] driven by a motor [and] with a blade guide and produces a substantially burr-free cutting edge.

SUMMARY OF THE INVENTION

The invention relates to an improved [blade] sharpening apparatus having a grinding wheel for sharpening [cutting] blades by controlled grinding [means of an] of the cutting edge of the blade provided by means of an [adjustable] blade guide to produce multiple facets on the cutting blade with a substantially burr-free sharp cutting edge, an improved balde guide for use with the blade sharpening apparatus [for adjustably guiding [the] a [cutting] blade during sharpening and to provide] an improved method of sharpening [the cutting] a blade to form a burr free [an improved cutting] edge.

In particular, the invention concerns a [blade] sharpening apparatus having a base, [having a generally horizontal] a table having a mounting surface, [for] and a housing including a rotary grinding wheel having an axle disposed along a [having a] horizontal axis. [and for mounting a] In the preferred embodiment a drive, typically an electric motor is mounted on the base having a drive shaft to which is attached a drive pulley and the rotary grinding wheel [having] is provided with a circumferential [grinding] edge having a grinding surface driven by the drive by belt [means.]

The rotary grinding wheel is provided with an adjustable blade guide, adjustable in a radial plane and a vertical plane, [is provided] mounted on a coaxial axle on the central axis of the grinding wheel for positioning a [cutting blade], preferably a knife blade in [proper] controlled relationship to with [the] the guide surface of said grinding wheel [including]. The blade guide has a bottom which is supported by an adjustable support member. The adjustable support member is mounted on the mounting surface of the table and extends in a vertical plane perpendicular to the plane of the mounting surface, said support member being positioned in sandwiched relationship between [the mounting surface of the base and] the bottom of the blade guide and the support surface of the table for [adjusting the position of the] moving blade guide means between a first and a second sharpening position wherein the blade to be sharpened is [drawn] positioned in a horizontal [plane] path across the grinding [edge] surface of the grinding wheel, with the edge of the blade extending downwardly, whereby the cutting blade is supported on one side by the grinding [edge] surface and on the opposite side by the blade guide surface to produce a substantially burr-free leading edge of the blade.

In the preferred embodiment, the [blade] sharpening apparatus comprises a base for mounting [a] the rotary grinding wheel in a housing on a horizontally disposed axle to position the rotary grinding wheel in a vertical plane and for mounting a drive [means] in spaced apart relationship, preferably an electric motor connected by a belt drive to the rotary grinding wheel, the base having a horizontal table surface positioned in horizontal relationship and placed intermediate to [the] said grinding wheel and the motor.

[The rotary grinding wheel is mounted in perpendicular relationship to the mounting axle and includes a circumferential grinding edge of cylindrical construction and is driven by the electric motor mounted on the base,]. Said electric motor being mounted on a separate, spaced-apart parallel axle. [extending horizontally.]

In the preferred embodiment, [the sharpening apparatus] the blade guide includes a blade guide having a geometry related to the radius of the grinding wheel and [having] has a common axis of rotation, being mounted on a common axle and is adapted for positioning a knife blade in [proper] controlled selected relationship with the circumferential edge of the grinding wheel for controlling the angle of the blade facet ground on the cutting edge and for preventing burring of the tip of the edge by keeping the blade tip in spaced relationship with the grinding wheel and by providing narrower angles or grinding.

Burring of the tip is prevented by controlling the blade, by means of supporting the sides of the blade between the blade guide and the grinding wheel, said blade guide is adapted for holding the [cutting] guide surface blade in contact with the grinding wheel by contacting the outer side of the blade without touching the blade's leading edge, thereby avoiding forming a burr thereon which would otherwise destroy the sharpness of the edge. The blade guide [means] is pivotably mounted on the axle of the rotary grinding wheel, coaxialy therewith by a pair of arms whose length is determined by an adjustable apparatus for adjusting the relationship of the guide surface of the blade guide with the [radius] guide surface of the grinding wheel and is adapted to be adjustably mounted on the axle, the axle being the center of rotation of the blade guide means wherein the blade guide may be moved from a first grinding position with the guide support surface haivng a zero degree angle with the blade to a second sharpening position wherein the guide surface is positioned at an angle less than half the first facet angle and furthermore the blade guide is adjustable to accommodate for wear of the rotary grinding wheel circumferential surface. The blade guide includes a pair of outwardly extending arms with a pair of side arms extending upwardly, each guide arm having a guide surface for positioning the knife at a selected angle with respect to the circumferential peripheral edge of the grinding wheel.

In the preferred embodiment, the blade guide means is positioned on the axle of the rotary grinding wheel by an adjustable axle mount which is adjustable between an inner radial position and an outer radial position to adjust for grinding wheel wear such that as the diameter of the grinding wheel is reduced the guide surface of the blade guide can be moved inwardly to maintain its relationship with the circumferential peripheral grinding edge of the wheel. The adjustable axle mount is also movable radially inwardly or outwardly to adjust for varying knife sizes, particularly for varying cross-sectional thickness of knife size. The adjustable support member provides controlled vertical positioning of the blade guide [means] with respect to the guiding surface of the peripheral circumferential edge of the grinding wheel and includes a lower end attached to the horizontal table surface. Said support member is positioned in a vertical axis in perpendicular relationship with the table surface extending upwardly toward the blade guide [means] with the vertical support member being provided with the lower end and an upper end, the upper end adapted to cooperate with the bottom of the distal end of the outwardly extending arms. Said support member further includes a vertical adjustment device for upward and downward displacement for moving the blade guide means between a first selected position and a plurality of other sharpening positions relative to the fixed rotably mounted grinding wheel.

The invention provides a method for sharpening knives particularly cutlery used in the kitchen, including the steps of providing a circular grinding wheel adapted to be driven by a rotary motor mounted on a housing, the housing having a horizontal table surface, mounting a blade guide on the axis of the grinding wheel having a pair of arms being rotably mounted on the grinding wheel for defining a blade path in between the grinding wheel and the guide and supporting a blade to be ground on the grinding wheel, mounting an adjustable support member for vertical positioning the blade guide with respect to the grinding [wheel] surface, the position of the blade guide being controlled by the adjustable positioning of the support member along the vertical axis and drawing the blade generally perpendicularly with the edge facing downward across the grinding surface of the wheel on a first side and subsequently on a second side to form a pair of parallel facets having the same angle with respect to the longitudinal axis of the blade, drawing the blade successively across the grinding surface until the parallel facets come together to form an edge.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
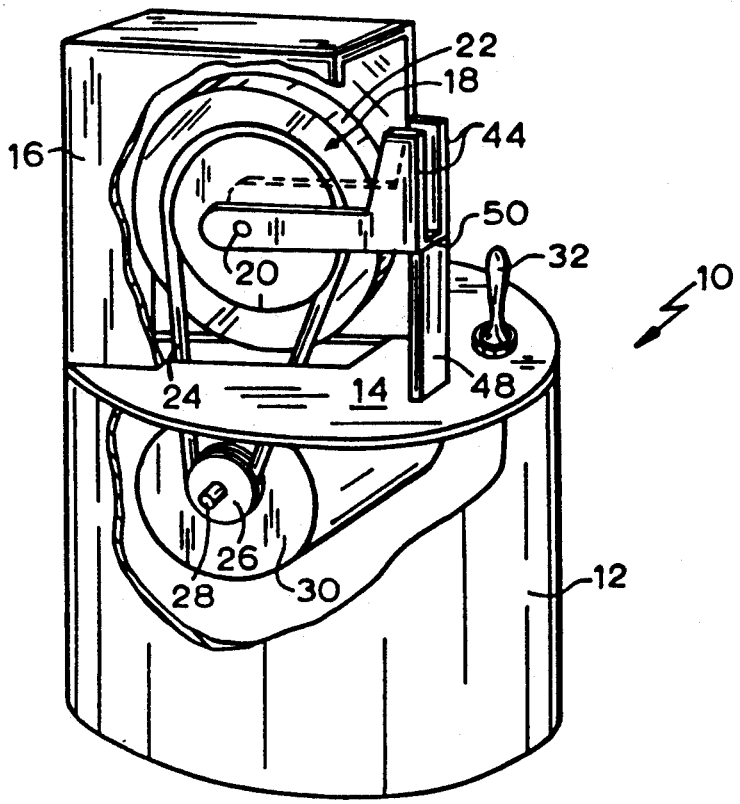
FIG. 1 is a perspective view from above the side of a blade sharpening apparatus of the invention.

The drawings show a blade sharpening apparatus 10 which includes a [fixed] base 12, [a] an intermediate horizontally-extending table surface 14, supporting a [vertically extending] housing 16 having an interior cavity [with] enclosing a rotary grinding wheel 18. The rotary grinding wheel 18 is mounted on an axle 20 [having] and includes an circumferential peripheral [cutting] grinding edge 22. The rotary grinding wheel 18 is rotably driven by a belt 21, preferably by a flexible belt of conventional synthetic rubber construction, mounted on a drive wheel 24, the belt 21 connected to a pulley 26. Said pulley is mounted on [the] a drive shaft 28 of an electric motor 30 mounted on the base 12 [and] positioned beneath [the] a table surface 14, the motor 30 being connected to an on/off switch 32 for controlling the operation of the motor.

Figure 2:
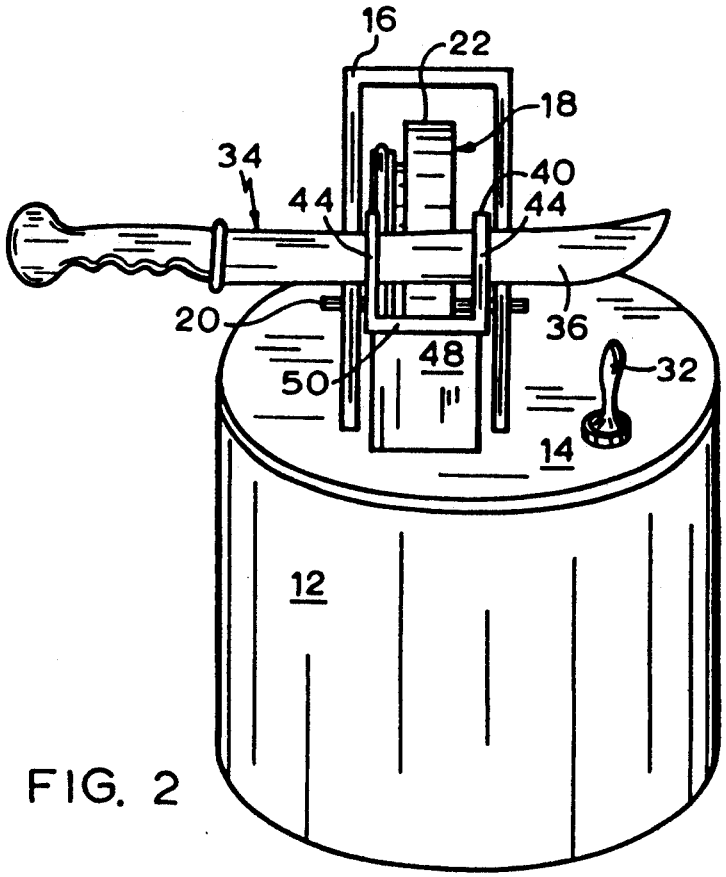
FIG. 2 is a perspective view from above and from the front of the blade sharpening apparatus of FIG. 1.
Figure 3:
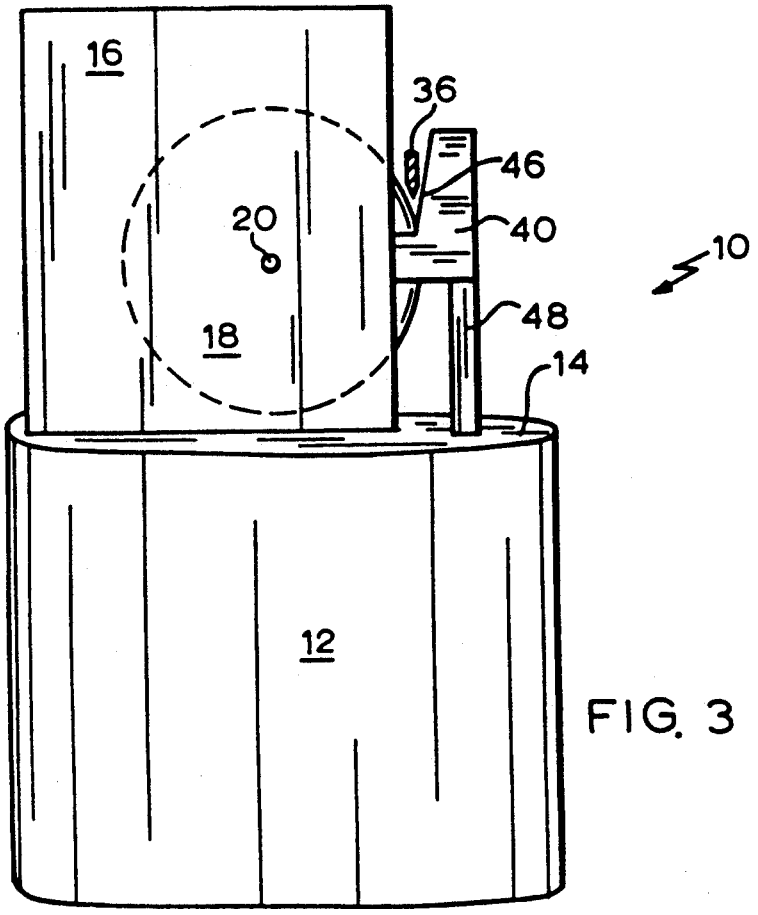
FIG. 3 is a side view of the blade sharpening apparatus of FIG. 1.

As shown in FIG. 2 a knife 34 having a blade 36 and a handle 38 is positioned in a vertical plane [along a horizontal axis] between the rotary grinding wheel 18 by a blade guide 40. As is shown in FIGS. 1 & 2 the blade guide 40 includes a pair of arms 42 and a pair of upwardly extending fingers 44 having a guide surface 46 positioned adjacent the circumferential peripheral edge 22. A support member 48 extends vertically from the upper surface of the table surface 14 having a first end and a second end, the first end being adapted to be mounted on the table surface 14 and the second end adapted to support [the] a mounting surface 50 shown in FIG. 2 extending between the fingers 44 and in perpendicular relationship therewith. The support member 48 includes vertical adjustment apparatus 52 for displacing the blade guide 40 [upwardly and downwardly] between and upward position for grinding a wide angle and a downward position for grinding a narrow angle, including an upper end 54, a lower end 56, a pair of spaced-apart guide channels 58, a central adjustment channel 60 in coplanar parallel relationship with the guide channels 58, a pair of parallel spaced-apart outer shafts 62 and a central adjustment threaded device 64 mounted on a nut 66. Rotation of the threaded device 66 causes the upper end to move with relationship to the lower end either in an upwardly or a downwardly position for positioning the blade guide upwardly or downwardly.

Figure 4:
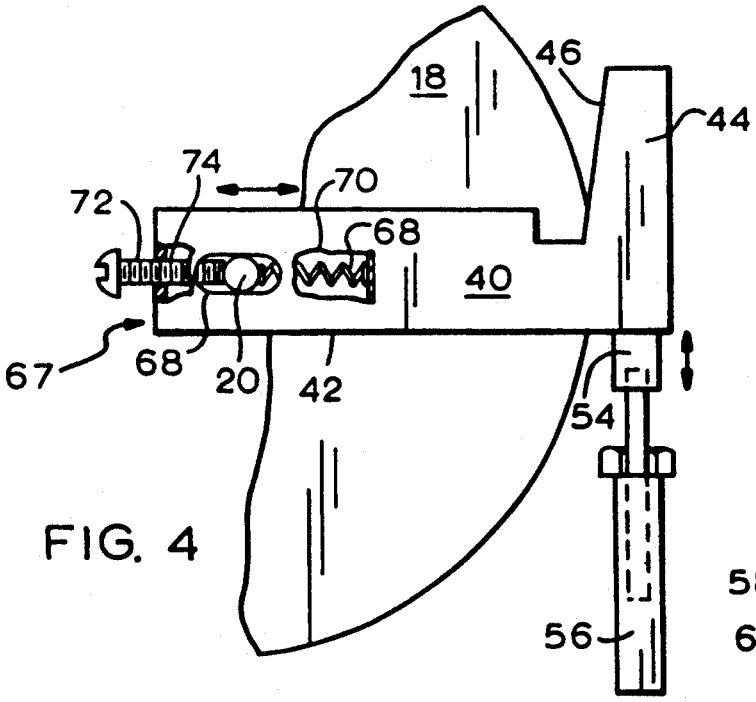
FIG. 4 is an exploded side plan view of the blade guide means mounted on the rotary grinding wheel showing the vertical support member.
Figure 5:
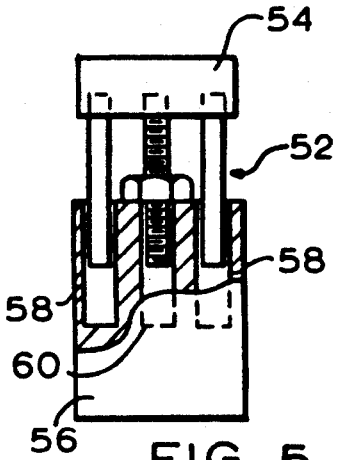
FIG. 5 is an exploded front plan view of the vertical support member of the invention shown in FIG. 4.
Figure 6:
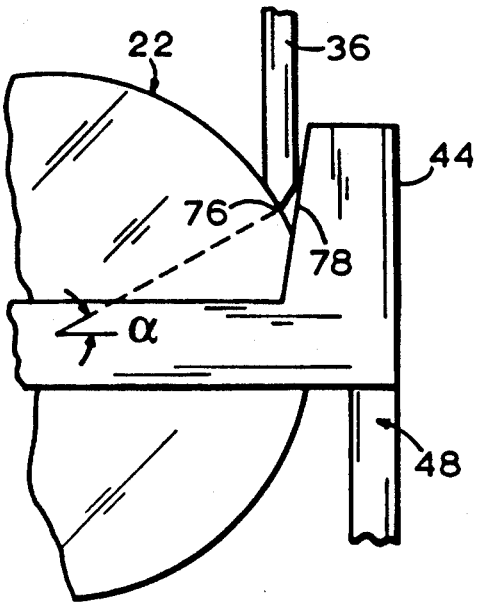
FIG. 6 is a sectional view of the grinding wheel, the arm portion of the blade guide means and a blade with the guide at zero degree angle.

As shown in FIG. 4, the blade guide 40 includes an adjustable mounting apparatus 67 adapted to cooperate with the axle 20 of the grinding wheel 18 including an elongated aperture 68 extending along the longitudinal axis. Each arm 42 of the blade guide [arm,] 40 a compression spring 68 mounted in a longitudinal cavity 70 and a spaced-apart opposed adjusting screw 72 mounted in a longitudinally extending threaded aperture 74. Movement of the threaded screw 72 by threading inwardly causes the [blade guide] arms 42 to be displaced in a direction away from the support member causing the guide surface 42 to move inwardly toward the [outer] circumferential [perferential] grinding edge 22 of the blade guide 40. for grinding a wide facet on the blade as shown in FIG. 6. Threading in the opposite direction would cause the guide surface to move outwardly and away from the circumferential peripheral edge 22 of the grinding wheel.

Figure 7:
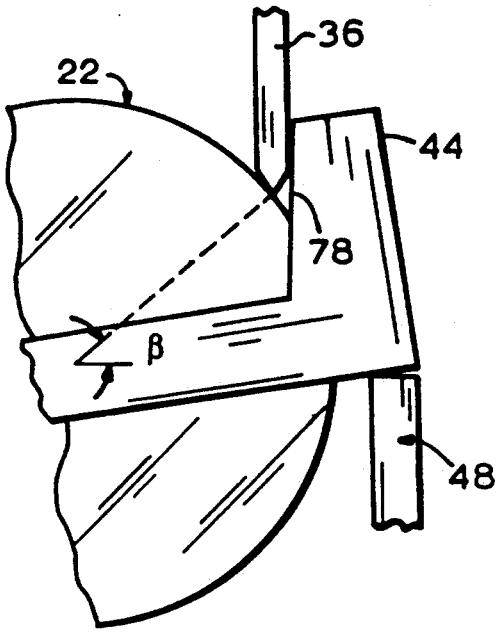
FIG. 7 is a sectional view of the rotary grinding wheel, the arm of the blade guide means and a blade with the angle of the guide less than blade half angle.
Figure 8:
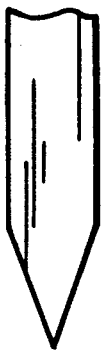
FIG. 8 (PRIOR ART)
FIG. 8 is a sectional view of a prior art blade.

As shown in FIG. 6 prior art blades permit the tip of the blade to touch the periphery of the grinding wheel. As shown in FIG. 7 where the angle of the guide surface 78 is constructed to be less than the blade half angle which is measured from the central axis of the blade. The blade tip 76 does not touch the outer circumferential peripheral edge of the grinding stone 22.

Figure 9:
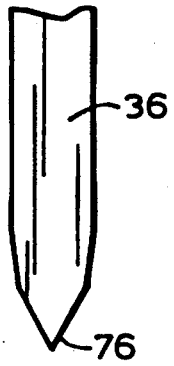
FIG. 9 is a sectional view of the blade showing pairs of facets ground to form a cutting edge according to the invention.

As shown in FIG. 9, multiple facets are formed on the side of the cutting edge 80 of blade 36.

What is claimed is:

1. A sharpening apparatus for sharpening blades comprising;

a) grinding means for grinding a blade having an inner side and an outer side to produce a sharpened cutting edge, said grinding means comprising a rotary grinding wheel mounted on an axle;

b) a grinding surface on the circumferential, peripheral edge of the rotary grinding wheel;

c) blade guide means for positioning the blade at a plurality of selected positions relative to the grinding surface for grinding a plurality of blade facets;

d) a guide surface adapted for supporting the outer side of the blade to position said blade between the grinding means and the blade guide means said guide surface having a constant angled relationship with said grinding surface;

e) base means for mounting a drive means for driving the grinding means, said base means including a horizontally extending table member;

f) a housing attached to the base means for mounting the axle of the rotary grinding wheel to position the grinding means in spaced apart relationship with the drive means;

g) support means for selectively positioning the blade guide means relative to the grinding means, said support means extending vertically between the table member and the bottom of said blade guide means, and having adjustment means for selective extension and retraction of said support means wherein the blade is oriented in a generally vertical plane with a cutting edge extending downwardly to provide a horizontal sharpening path across the grinding surface in a controlled relationship defined by the blade guide means by supporting the blade between the grinding surface on one side of the blade and the guide surface on the opposite side of the blade such that the leading edge of the blade is kept in spaced apart relationship with the grinding surface.

2. The sharpening apparatus of claim 1 wherein the rotary grinding wheel includes a circumferential grinding surface driven by a belt connected to the drive means.

3. The sharpening apparatus of claim 1 wherein the table member extends in a generally horizontal plane extending outwardly from the base means and in a perpendicular relationship with the longitudinal axis of the rotary grinding wheel.

4. The sharpening apparatus of claim 1 wherein the support means is oriented vertically such that the lower end is supported by the horizontal table surface, the vertical support member being oriented in perpendicular relationship therewith for adjustment of the blade guide means in selected vertical positions relative to the flat horizontal table surface permitting the knife blade to be drawn across in a horizontal plane in successive steps for sharpening, grinding facets in successively larger angles with respect to the central axis of the blade.

5. The sharpening apparatus of claim 1 wherein the drive means includes an electric motor and a drive belt connected to pulleys.

6. The sharpening apparatus of claim 1 wherein the blade has a linear cutting edge comprising a blade having a geometry comprising multiple facets and a unitary leading edge.

7. The sharpening apparatus of claim 1 wherein the axle is mounted on an adjustable axle mounting means is adjustable for movement of the mounting surface radially between an inner position adjacent the grinding surface and an outer position spaced away from the grinding surface.

8. The sharpening apparatus of claim 1 wherein the blade guide means is adjustable for controlling the facets ground by the grinding wheel by movement in the vertical plane upwardly and downwardly by adjustment of the support means.

9. The blade sharpening apparatus of claim 1 wherein the blade guide means is adapted for holding the blade in a vertical plane with the knife edge extending downwardly by contacting the outside of the blade without touching the blade's leading edge.

10. The sharpening apparatus of claim 1 wherein the blade guide means is pivotably mounted on the axle of the grinding wheel by a pair of arms.

11. The sharpening apparatus of claim 1 wherein the blade guide surface is inclinded at a constant angle with respect to the arms for positioning the blade during sharpening.

12. The blade sharpening apparatus of claim 1 wherein the support means comprises a plurality of spaced apart guide channels:

ii) a central adjustment device iii) a pair of parallel spaced apart outer shafts iv) a central adjustment means for moving the upper end from the between and extended position and a contracted position for moving the blade guide means between a plurality of selected vertical positions with respect to the grinding surface.

13. The sharpening apparatus of claim 1 wherein the blade guide means is adapted to move between a first blade sharpening position and a second blade sharpening position in a vertical plane wherein the blade is sharpened by contacting the sides of the blade by the curved circumferential surface comprising:

i) a pair of arms ii) a transverse pivot means extending perpendicular to the longitudinal axis of the guide iii) a first guide arm;

iv) a second guide arm each arm formed with an incline facet angle guide surface;

v) a support member positioned between the blade guide means and the shelf support having an upper end and a lower end and including adjustment means for movement of the upper end relative to the lower end, said support member extending generally vertically upward from said support surface for adjustably supporting the base of the blade guide.

14. A method of sharpening a blade utilizing the blade sharpening apparatus of claim 1 comprising the steps of;

a) providing a circular grinding wheel adapted to be driven by a motor mounted in a housing attached to a frame with a horizontal table surface;

b) mounting a blade guide on the axis of the grinding wheel having a pair of arms one end being rotably mounted on the grinding wheel for defining a blade path and supporting a blade to be ground on the grinding wheel;

c) mounting a support for positioning the guide, the mounting of the post being supported on the table surface adjacent the grinding edge;

d) securing the guide in a first preselected position and placing the blade to be sharpened on the guide means with the leading edge of the blade in spaced relationship with the guide means;

e) drawing the blade perpendicularly across the grinding surface of the wheel on a first side and subsequently on the second side to form a pair of parallel facets having the same angle with respect to the longitudinal axis of the blade and to produce a sharp, essentially burr-free, cutting edge.

* * * * *